US005380242A

United States Patent [19]

Matsumoto et al.

[11] Patent Number: 5,380,242

[45] Date of Patent: Jan. 10, 1995

[54] COIN PROCESSOR FOR USE WITH AUTOMATIC VENDING MACHINES

[75] Inventors: Sadao Matsumoto, Kounan; Hiroaki Mannen, Oota, both of Japan

[73] Assignee: SANYO Electric Co., Ltd., Osaka, Japan

[21] Appl. No.: 21,458

[22] Filed: Feb. 23, 1993

[30] Foreign Application Priority Data

Feb. 28, 1992 [JP] Japan ..... 4-43192

[51] Int. Cl.[6] ..... G07D 3/16

[52] U.S. Cl. ..... 453/3; 453/17; 453/20

[58] Field of Search ..... 453/2, 3, 17, 20, 21, 453/32; 194/217, 218

[56] References Cited

U.S. PATENT DOCUMENTS 4,364,404 12/1982 Hayashi et al. ..... 453/20
4,558,711 12/1985 Ikuta Yoshiaki et al. ..... 453/3

FOREIGN PATENT DOCUMENTS 0151761 1/1984 European Pat. Off. .
0119006 9/1984 European Pat. Off. .
0167181 1/1986 European Pat. Off. .
0287049 4/1987 European Pat. Off. .
0305290 1/1989 European Pat. Off. .
0355238 2/1990 European Pat. Off. .
54-49994 of 1979 Japan .
1-79172 5/1989 Japan .
1-29665 9/1989 Japan .

*Primary Examiner*—F. J. Bartuska
*Attorney, Agent, or Firm*—Armstrong, Westerman, Hattori, McLeland & Naughton

[57] ABSTRACT

A coin processor is described in which coins deposited in a vending machine classified according to value in coin storage cylinders and wherein a coin recovery system includes a controller for controlling the discharge mechanisms operative with the respective coin storage cylinders to enable, when desired, the recovery of coins from the storage cylinder according to a predetermined sequence by actuation of a prescribed switch or, alternatively, recovery of coins from any particular storage cylinder by actuation of a switch associated therewith. The controller is capable of overriding the sequenced discharge of coins from the respective cylinders upon subsequent actuation of a required switch. The described processor employs a preset counter and a change detection sensor associated with each respective coin storage cylinder for terminating the coin discharge operation from each respective storage cylinder upon the discharge of a predetermined counted number of coins.

4 Claims, 7 Drawing Sheets

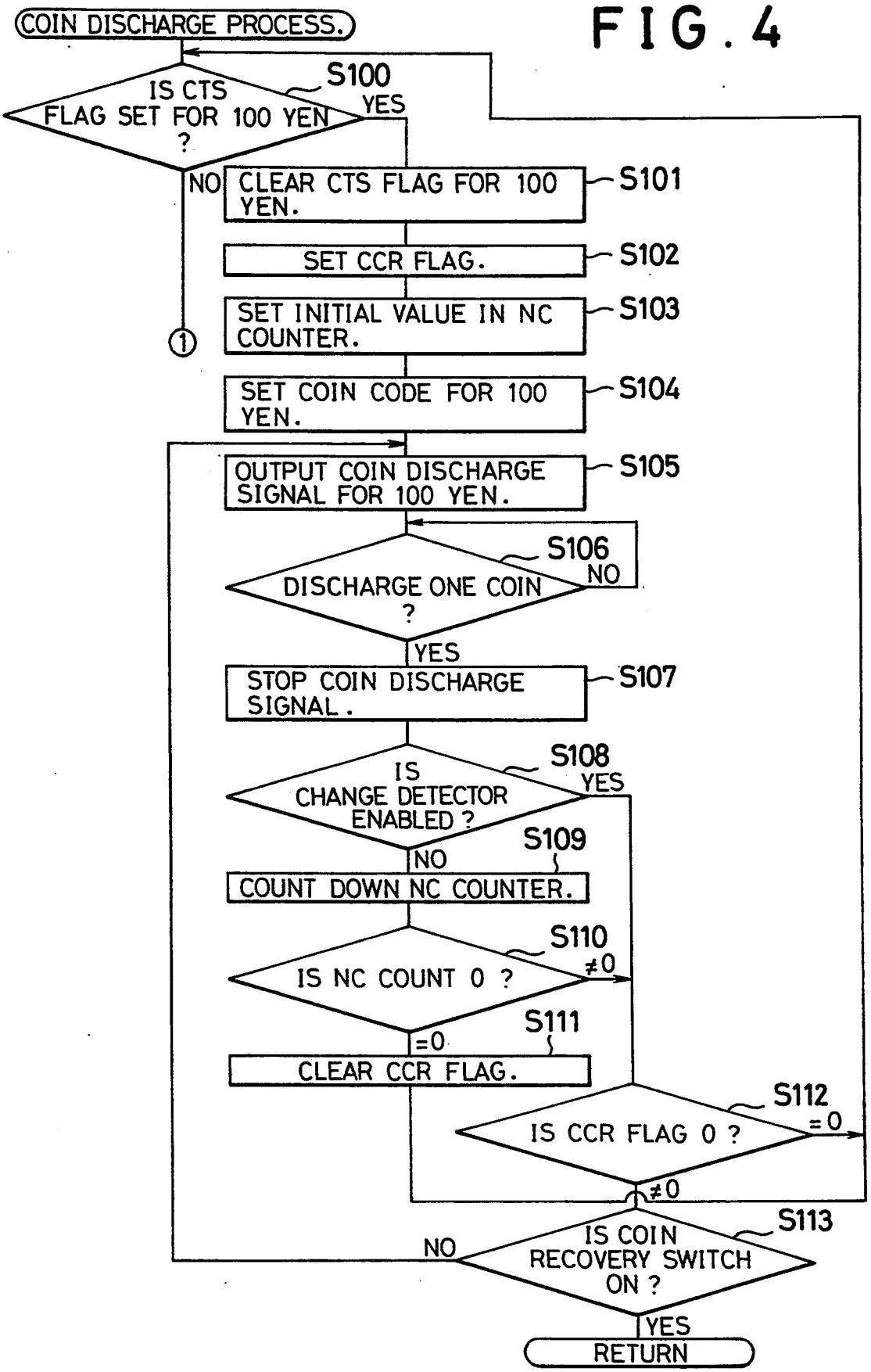
FIG. 4
COIN DISCHARGE PROCESS.
IS CTS FLAG SET FOR 100 YEN ?
S100
YES
NO
CLEAR CTS FLAG FOR 100 YEN.
S101
SET CCR FLAG.
S102
SET INITIAL VALUE IN NC COUNTER.
S103
1
SET COIN CODE FOR 100 YEN.
S104
OUTPUT COIN DISCHARGE SIGNAL FOR 100 YEN.
S105
DISCHARGE ONE COIN ?
S106
NO
YES
STOP COIN DISCHARGE SIGNAL.
S107
IS CHANGE DETECTOR ENABLED ?
S108
YES
NO
S109
COUNT DOWN NC COUNTER.
IS NC COUNT 0 ?
S110
≠0
=0
S111
CLEAR CCR FLAG.
IS CCR FLAG 0 ?
S112
=0
≠0
IS COIN RECOVERY SWITCH ON ?
S113
NO
YES
RETURN

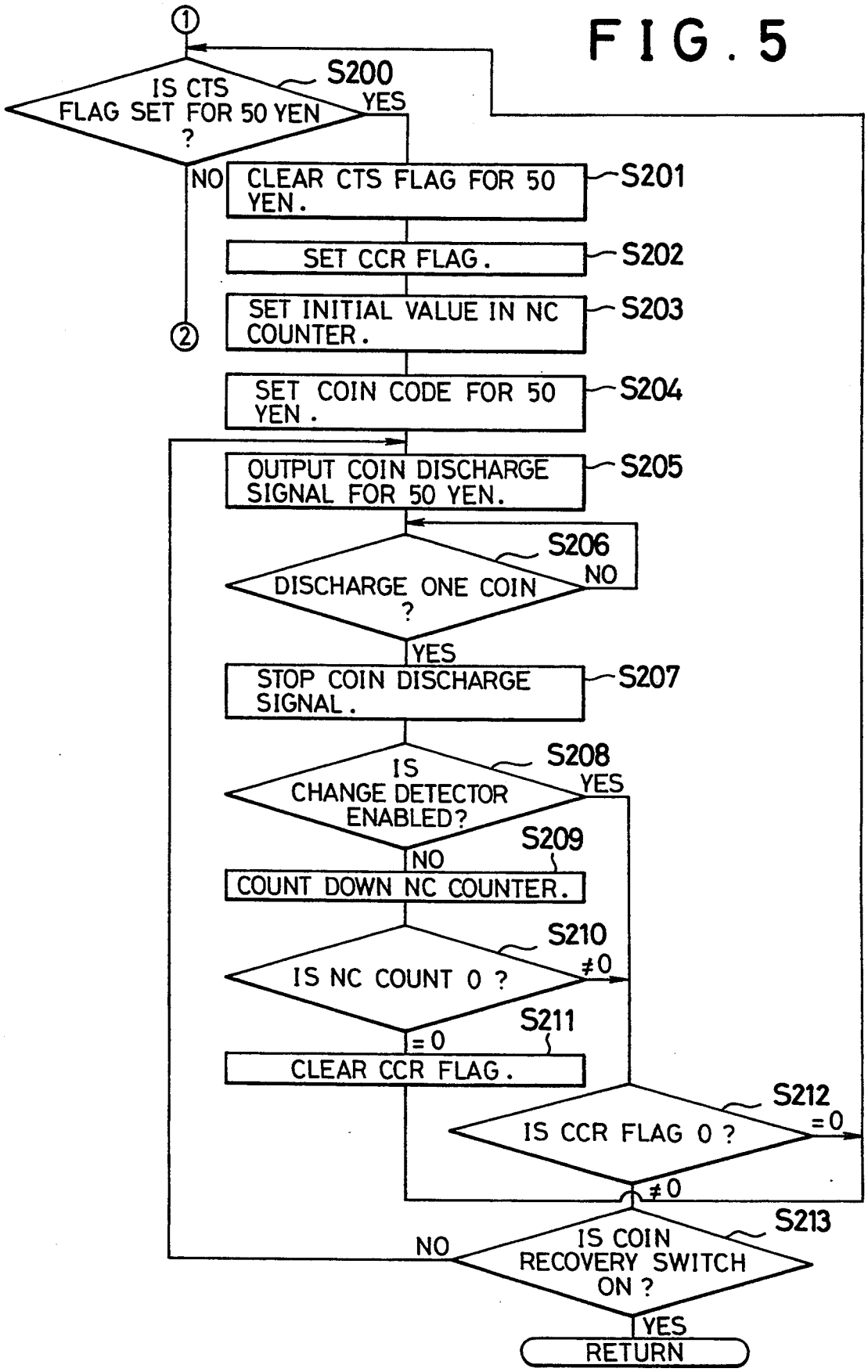
FIG. 5
1
IS CTS FLAG SET FOR 50 YEN ?
S200
YES
NO
CLEAR CTS FLAG FOR 50 YEN.
S201
SET CCR FLAG.
S202
SET INITIAL VALUE IN NC COUNTER.
S203
2
SET COIN CODE FOR 50 YEN.
S204
OUTPUT COIN DISCHARGE SIGNAL FOR 50 YEN.
S205
DISCHARGE ONE COIN ?
S206
NO
YES
STOP COIN DISCHARGE SIGNAL.
S207
IS CHANGE DETECTOR ENABLED?
S208
YES
NO
COUNT DOWN NC COUNTER.
S209
IS NC COUNT 0 ?
S210
≠0
=0
CLEAR CCR FLAG.
S211
IS CCR FLAG 0 ?
S212
=0
≠0
IS COIN RECOVERY SWITCH ON ?
S213
NO
YES
RETURN

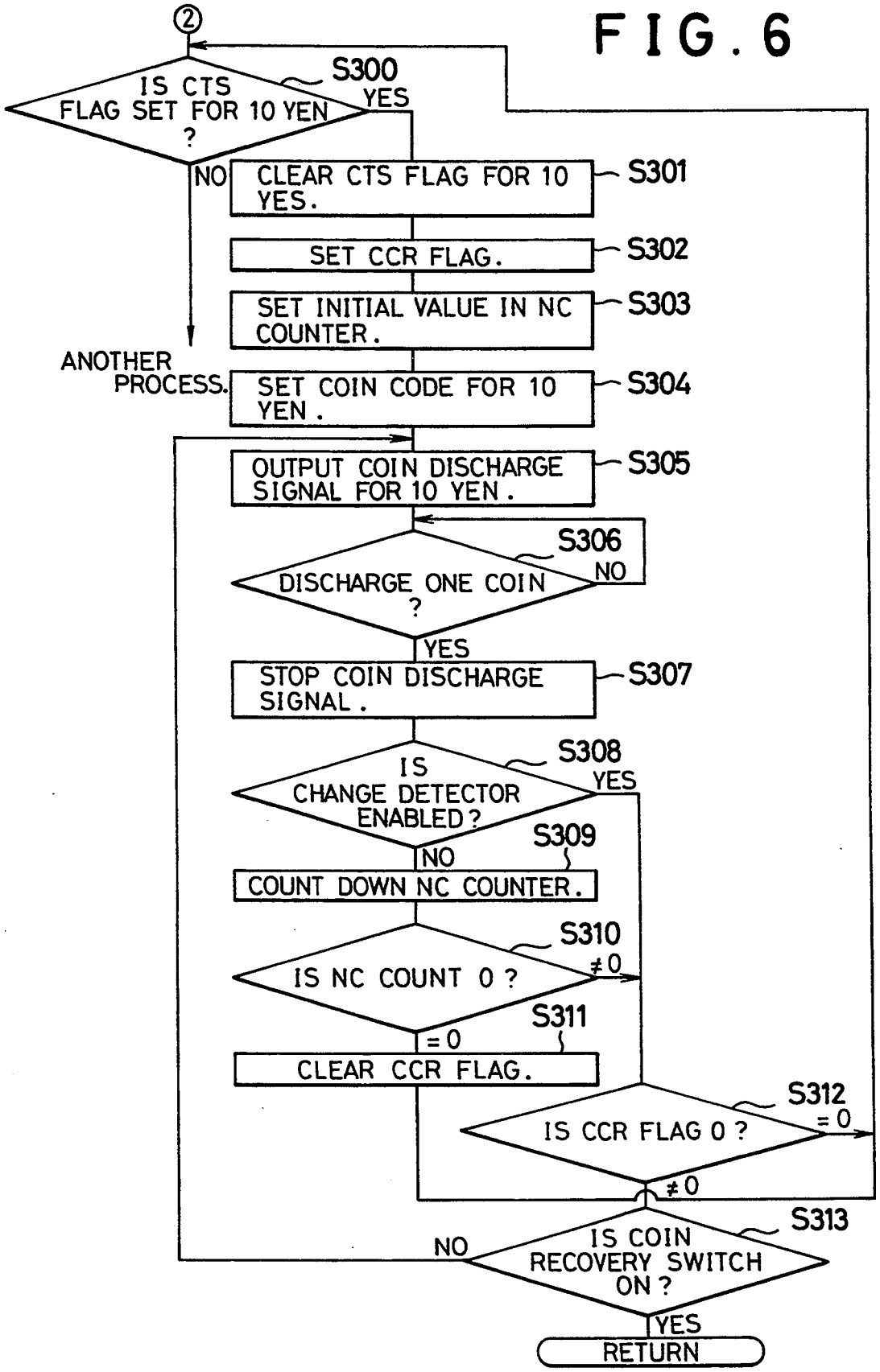
FIG. 6
②
IS CTS FLAG SET FOR 10 YEN ?
S300
YES
NO
CLEAR CTS FLAG FOR 10 YES.
S301
SET CCR FLAG.
S302
SET INITIAL VALUE IN NC COUNTER.
S303
ANOTHER PROCESS.
SET COIN CODE FOR 10 YEN.
S304
OUTPUT COIN DISCHARGE SIGNAL FOR 10 YEN.
S305
DISCHARGE ONE COIN ?
S306
NO
YES
STOP COIN DISCHARGE SIGNAL.
S307
IS CHANGE DETECTOR ENABLED?
S308
YES
NO
S309
COUNT DOWN NC COUNTER.
IS NC COUNT 0 ?
S310
≠0
=0
S311
CLEAR CCR FLAG.
IS CCR FLAG 0 ?
S312
=0
≠0
IS COIN RECOVERY SWITCH ON ?
S313
NO
YES
RETURN

COIN PROCESSOR FOR USE WITH AUTOMATIC VENDING MACHINES

FIELD OF THE INVENTION

The invention relates to a coin processor for use with automatic vending machines. More particularly, it relates to an improved coin recovery system of such coin processor.

BACKGROUND OF THE INVENTION

In an automatic vending machine coins are deposited into the machine and classified by values before they are stored in respective coin storage cylinders for future use as change. It is often necessary to discharge these coins at the time of replenishment of merchandise or sales accounting. To do this an operator operates a coin processor, as taught in Japanese Utility Models 54-49994 and 1-29565. In the case of a utility model disclosed in the former publication, an operator presses a button to discharge one type of coins from a coin cylinder having a first priority, and then he presses the button to discharge the next priority coins, and so on until a coin detector generates a signal to stop the operation. In the case of a utility model disclosed in the latter publication, types of coins are designated by the numbers of times that the button is pressed by the operator. The coins are discharged by pressing a start button.

As is understood from the above example, it is very tedious for the operator to discharge all types of coins from these prior art coin processors, since the operator must press the buttons repeatedly for every type of coins. Nevertheless, it is a common practice to recover all the coins when maintenance service is needed, since automatic vending machines are installed in public places. Prior art coin processors also require a detection means for detecting the end of such coin recovery operation, which implies that additional cost is required for those elements.

Thus, conventional coin processors for automatic vending machines disadvantageously not only suffer from low efficiency but also bear cost for seemingly superfluous elements.

SUMMARY OF THE INVENTION

An object of the invention is to provide an improved, yet low-cost, coin processor for use with automatic vending machines, having a high coin recovery efficiency.

In view of the objective as mentioned above, a coin processor for use with automatic vending machine is provided according to the invention. The coin processor comprises:

- a coin classifying mechanism for classifying coins deposited in the automatic vending machine;
- a multiplicity of coin storage cylinders for storing the coins classified by the coin classifying mechanism;
- change sensors provided one for each said coin cylinder for sensing predetermined number of coins in the cylinders;
- a multiplicity of coin discharging mechanisms provided one for each said coin storage cylinder;
- a multiplicity of coin recovery switches for enabling said discharging mechanisms so as to recover coins from said storage cylinders;
- a controller for controlling the operations of said coin discharging mechanisms such that said coin discharging mechanisms discharge coins from the coin storage cylinders one by one in response to signals received from said coin recovery switch, and the coin processor is characterized in that
- said coin recovery switches comprise an entire coin recovery switch for recovering the entirety of the coins from the coin storage cylinders, and a multiplicity of one-type coin recovery switches for recovering from said storage cylinders specific types of coins designated by said coin recovery switches operated; and
- said controller controls said coin discharging mechanisms so that the entirety of the coins are discharged from said coin storage cylinders in sequence according to priority assigned to each of said cylinders in response to the signal received from the entire coin recovery switch.

With this coin processor, it is possible to recover all types of coins sequentially in the order of predetermined priority by operating the entire coin recovery switch only once, thereby eliminating an operator's tedious manipulations of coin recovery switches.

The controller preferably comprises initial value setting means for presetting an initial number for each of the coin storage cylinders, said initial number being greater than the maximum number that the change detection sensor can sense; and a counter for counting down the count stored in the counter by one every time the coin discharging mechanism associated with the counter is operated after the corresponding change sensor sensed the preset initial number, and for stopping the coin discharging mechanism when the number is counted down to zero.

With this controller, no additional detection means is required for coin recovery system as is required in conventional coin processor, since the end of coin discharge process routine is detected by the change detection sensors. Thus, the coin processor may be manufactured less costly and has high coin recovery performance.

The controller preferably comprises stopping means for stopping the coin discharge process initiated by a first operation of the entire coin recovery switch in response to a second operation of the entire coin recovery switch.

Such stopping means described above enables stopping of the coin recovery operation in case of emergency.

The controller preferably comprises shift means for stopping the current coin discharge process initiated by the operation of the entire coin recovery switch if one of the one-type coin recovery switches is operated during the coin discharge process, and for executing the coin recovery operation instructed by said one-type coin recovery switch.

With this shift means it is possible to recover from the coin storage cylinders coins having higher priorities, leaving desired amount of coins in the storage cylinders if so a desired, and then shift to coin recovery operations for other types of coins having lower priori ties.

The controller preferably comprises selection means for switching from one coin discharge process initiated by one of the one-type coin recovery switches to another coin discharge process for another type of coins if another one of the one-type coin recovery switches is operated.

With this controller, it is possible to leave a desired amount of coins in each coin storage cylinder.

BRIEF DESCRIPTION OF THE DRAWINGS

FIGS. 4 through 6 collectively show a flowchart for a "coin discharge process" sub-routine executed by the controller of the coin processor of FIG. 1.

DETAILED DESCRIPTION OF THE PREFERRED EMBODIMENT

Figure 1:
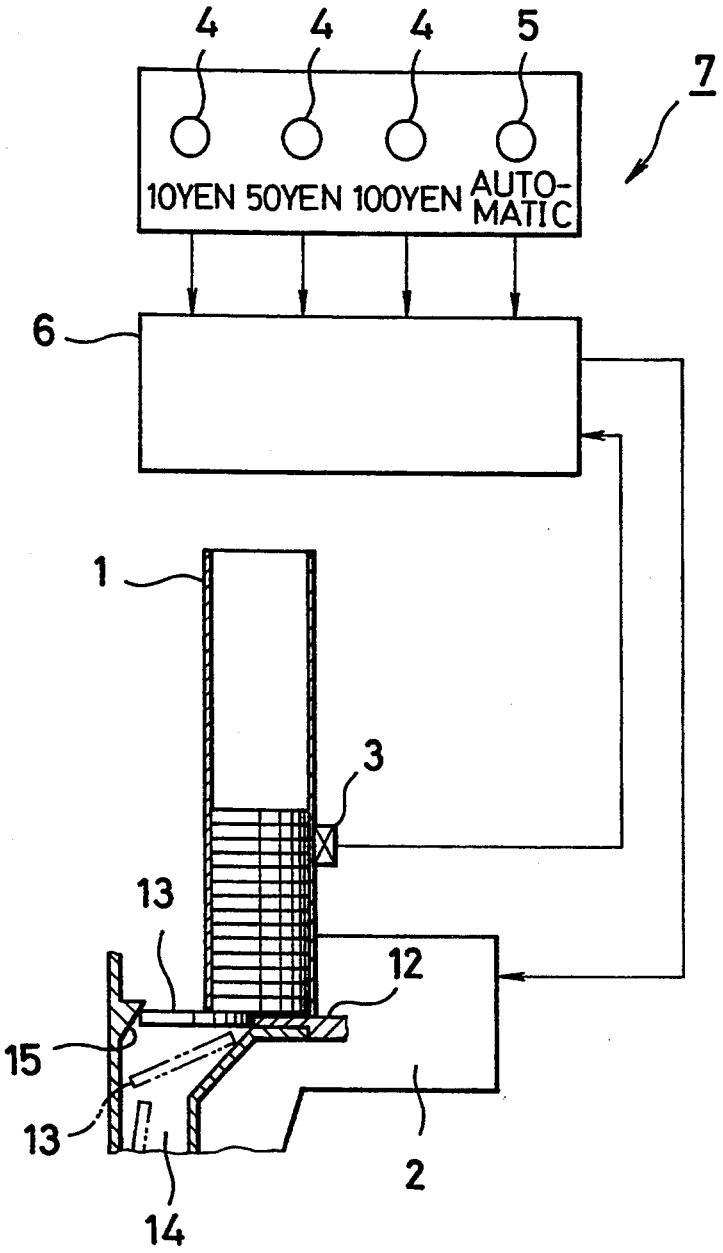
FIG. 1 is a schematic view of a controller in communication with other components of a coin processor according to the invention.
Figure 2:
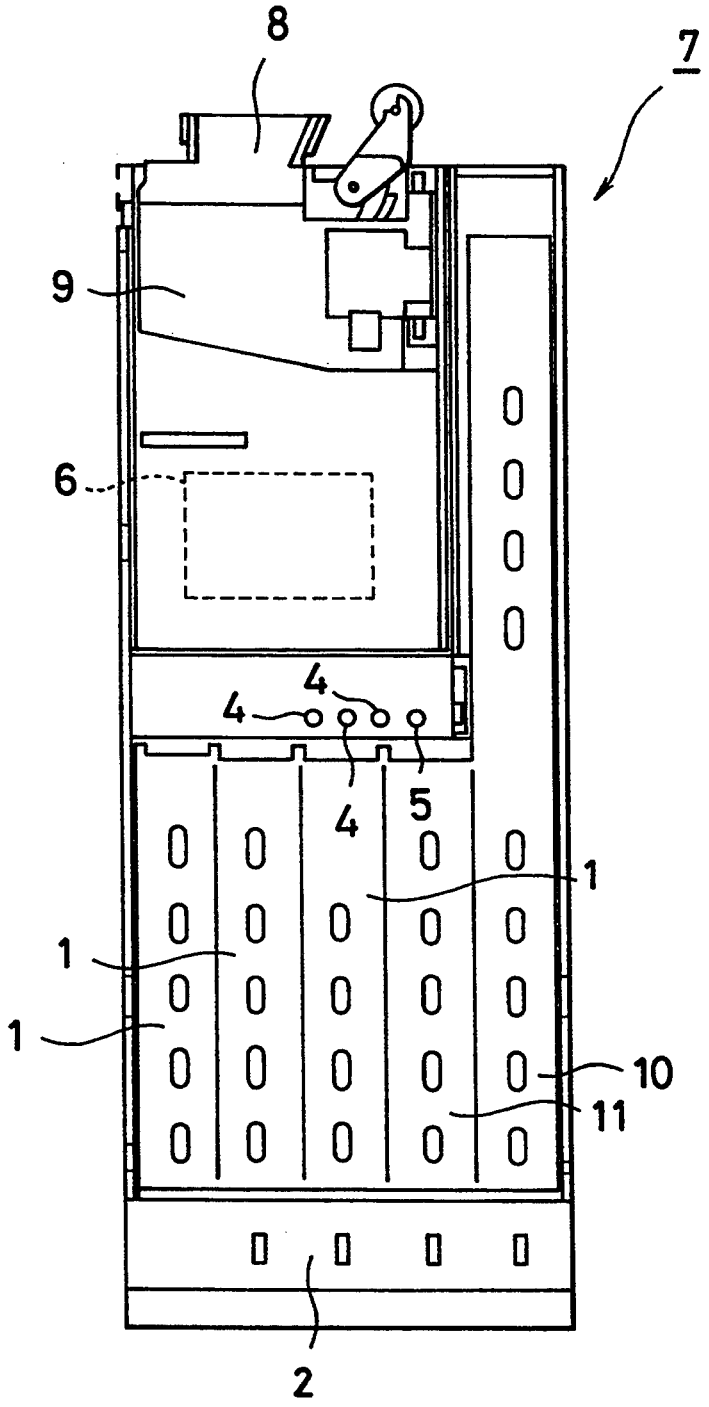
FIG. 2 is a front view of the coin processor of FIG. 1.

The invention is now described by way of example with reference to the accompanying drawings. Referring to FIGS. 1 and 2, there is shown a coin processor 7 of the invention, comprising a multiplicity of coin storage cylinders 1 for storing coins which were deposited by customers and classified by values as stated below; coin discharging mechanisms 2 for discharging coins from the respective coin storage cylinders 1; change detection sensors 3 for sensing if coins remain in the cylinders more than a predetermined amount; coin recovery switches 4 for initiating a coin recovery operation for a designated type of coins from a corresponding one of the coin storage cylinders 1; an entire coin recovery switch 5 for recovering all types of coins stored in the coin storage cylinders 1; a controller 6 including a microprocessor (CPU), ROM, and RAM for controlling the operations of the coin storage cylinders 1, coin discharging mechanisms 2, change detection sensors 3, coin recovery switches 4, and the entire coin recovery switch 5.

It should be apparent to those skilled in the art that although the invention is described for a coin processor dealing with three types of coins, including 10 yen, 50 yen, and 100 yen, the invention is not limited to the three types, and that the invention can readily be applied to arbitrary combinations of any other types of coins.

Coins deposited in an automatic vending machine through a coin slot 8 of the coin processor 7 will drop into a coin classifying mechanism 9 where coins are tested for their genuineness and values. The coins are classified by values and then stored in respective coin storage cylinders 1 according to their values.

The controller 6 receives a signal indicative of genuineness and values of the deposited coins, signals from the change detection sensors 3 indicative of whether or not a number of coins exceeding a preset number of coins is present in each coin storage cylinder, and signals from merchandise buttons mounted on a control panel provided on the vending machine, indicative of the prices of the merchandise selected. The controller 6 calculates the amount of change, determines on the basis of these signals if there is enough change, and, if there is, determines if the merchandise can be vendable, and executes a change refund operation following the vending.

The change refund operation includes activation of levers 12 provided in respective coin discharging mechanisms 2 in response to the instruction given by the controller 6. The lever 12, when activated, forces the lowest coin 13 in the coin storage cylinder 1 into a coin discharge path 14. The coin 13 forced into the coin discharge path 14 is first pushed in a horizontal direction, abuts on a slanted portion 15 of the discharge path 14, and drops downward.

As a result of vending operations, various kinds of coins are stored in the coin storage cylinders 1 of the vending machine. These coins must be recovered during the maintenance service to the vending machine, for reasons stated previously. An example of the recovery operation, particularly in the case where coin storage cylinders 1 are filled with coins, will be now described with reference to FIGS. 3–6.

The CPU of controller 6 executes various sub-routines shown by a flowchart in FIGS. 3–6. After executing any one of the sub-routines, the CPU returns to a main process (not shown) related to other portions of a vending operation. For example, when the CPU enters a "key input" sub-routine shown in FIGS. 3A and 3B from the main routine, it returns once to the main routine after the completion of the sub-routine, and then enters another sub-routine such as "coin discharge process" sub-routine, as shown in FIGS. 4–6. It should be noted that, although not shown in the flowchart, there are many flags involved in the sub-routines, which are all set to 0 (i.e. cleared) at the time of initialization.

Figure 3A:
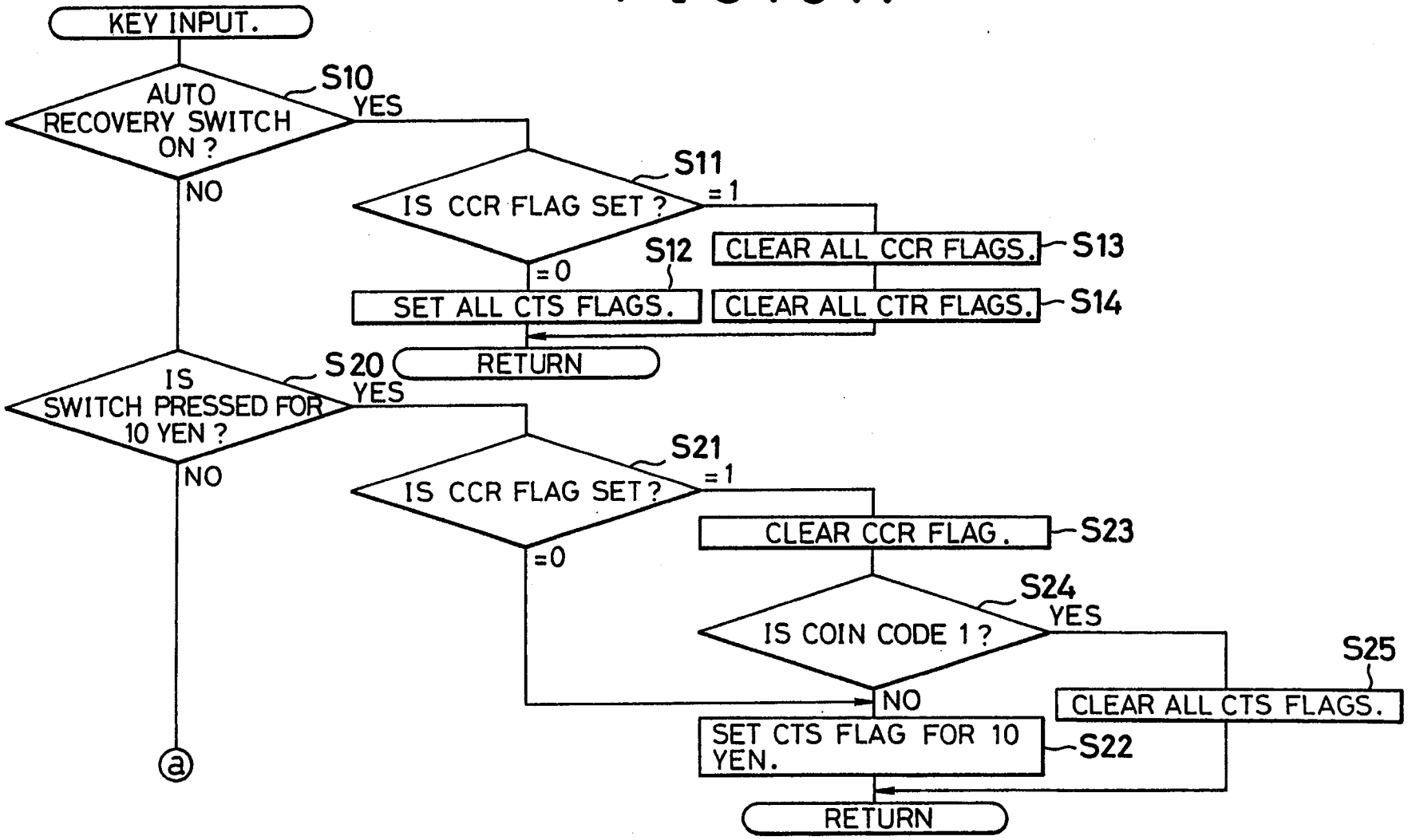
FIGS. 3A and 3B are parts of a comprehensive flowchart for a "key input" sub-routine executed by the controller of the coin processor of FIG. 1.
Figure 3B:
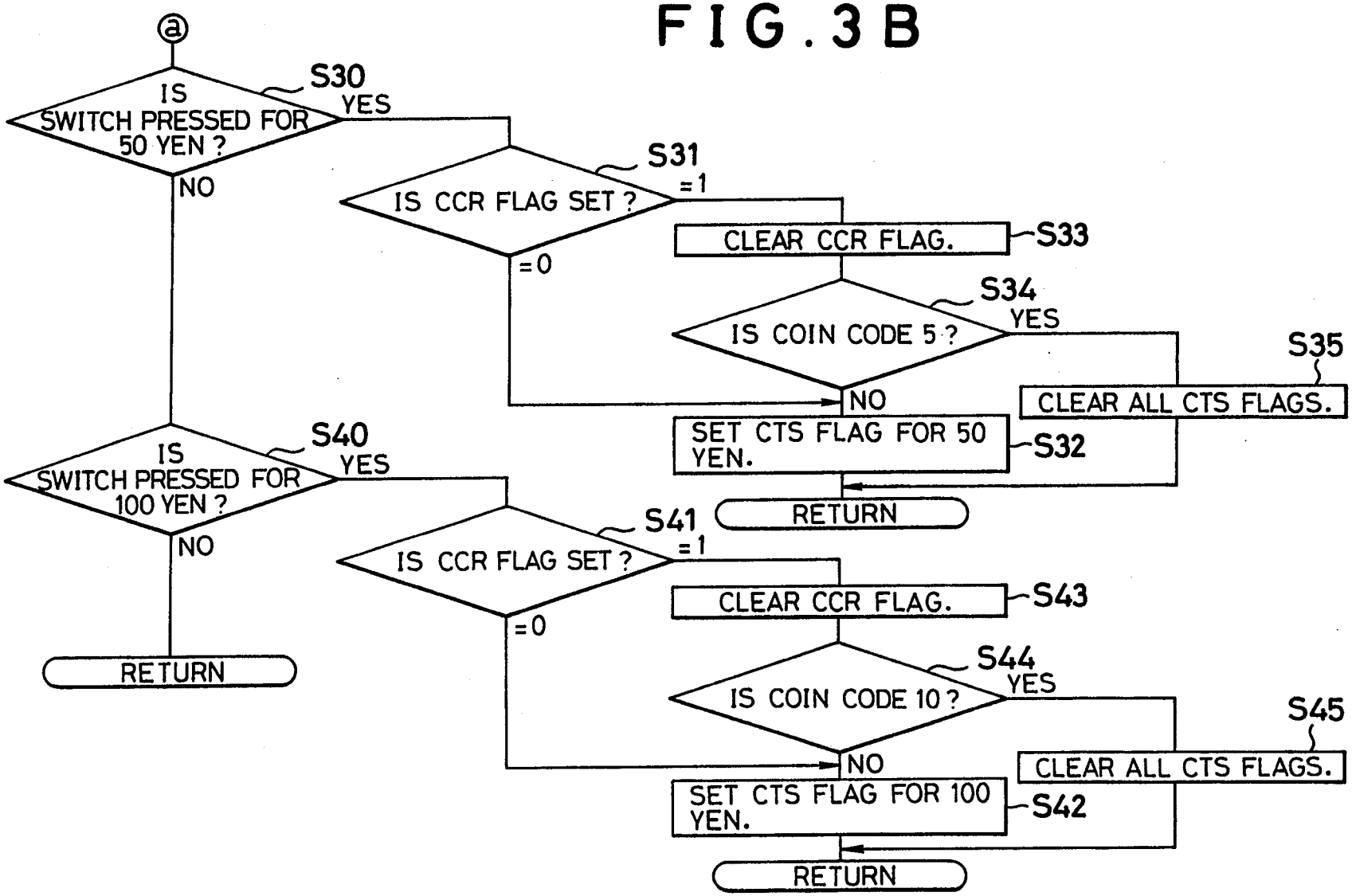

When the controller 6 is in its standby condition, it repeats a process to enter from the main routine to the sub-routine "key input" as shown in FIGS. 3A and 3B, undergoes steps S10, S20,S30, and S40 and then returns to the main routine. Under this condition, if the entire coin recovery switch 5 is pressed, the CPU recognizes the operation of the switch 5 in the step S10, proceeds to step S11 where a determination is made whether a flag indicative of if the controller 6 is currently in coin recovery operation and denoted by CCR flag (implying Current Coin Recovery flag) in the Figure, is set or cleared (to be 1 or 0, respectively).

Since all the flags are initially cleared, as described above, the process proceeds to step S12, where all the "coin type selection" flags, denoted by CTS flag (for 10, 50, and 100 yen) are set to 1, and returns to the main routine.

When the CPU thereafter enters from the main routine the sub-routine "coin discharge process" sub-routine starting from the step S100 shown in FIG. 4, a determination is made in the Step S100 as to the condition of the CTS flag for 100 yen. If the flag is set, the CPU proceeds to the step S101 to execute automatic coin recovery operation for 100 yen coins.

In the step S101, the CPU clears the 100 yen selection flag and proceeds to step S102 to set the CCR flag indicating that the 100 yen coin recovery operation is undergoing. In the exemplary coin processor described herein the processor takes into account the precision of the change detection sensors. The actual number of coins that can be counted correctly by the change detection sensor ranges from 13 to 19, inclusive for 100 yen coins. Therefore, in the step S103, a maximum countable number for the change detection sensor, which is 20 in the example described herein, is set in a null change counter (referred to as NC counter) associated with the change detection sensor for 100 yen coins. In step S104 the CPU sets a coin code in the RAM, which represents 100 yen.

After the setting the maximum countable number of 20 in the initialization step described above, the CPU instructs the controller 6 to generate a signal indicative of discharging 100 yen coins to the coin corresponding discharging mechanism 2 so that the lever 12 of the coin storage cylinder 1 for 100 yen coins is activated. Following this step the CPU confirms the end of the coin discharge process in step S106, and proceeds to step S107 where the coin discharging signal generated from the controller 6 to the coin discharging mechanism 2 is stopped. In step S108 the CPU checks the state of the signal received from the change detection sensor 3.

Since in the example described herein assumes, as the initial condition of the coin discharge process, that the coin storage cylinder is filled with coins, the state of the signal outputted from the change detection sensor 3 is "YES" (representing that "coins are present"), so that the CPU proceeds to step S112, where a determination is made if the CCR flag is set. Since the flag has been now set in the step S102, the CPU proceeds to step S113, where a determination is made if either another coin selection switch 4 or the entire coin recovery switch 5 is operated during the current coin recovery operation. If not, the CPU returns again to the step S105 to continue the current coin recovery operation for 100 yen coins.

If on the other hand either one of the switches has been pressed, the CPU branches from the step S113 back to the main routine once, and then enter the "key in" sub-routine shown in FIGS. 3A and 3B. In this sub-routine, the CPU goes to the step S11 via the step S10. In the step S11, the CCR flag, indicating that the coin recovery process is undergoing, is found to be set, since the coin recovery operation is undergoing. The CPU therefore proceeds to the step S13 where the CCR flag is cleared. In the step S14, all the flags are cleared. The CPU then returns to the main routine. When the CPU returns from the main routine to the "coin discharge process" of FIG. 4, it finds in the step S100 that the coin type selection flag, CTS flag, for 100 yen coins is cleared, so that the CPU will not proceed to the subsequent steps that follow S105, but stop the coin discharge process and return to the standby condition.

On the other hand, if none of the other coin recovery switches has been pressed during the current coin recovery operation for 100 yen coins, the 100 yen coins remaining in the coin storage cylinder 1 continue to decrease in number, so that in the step S108 the signal outputted from the change detection sensor 3 for the 100 yen coins eventually; changes from "YES" to "NONE", which causes the CPU to proceed to step S109. It should be noted that under this condition the actual number of coins is between 13 and 19. In the step S109, the NC counter counts down its count (referred to as "NC count") by one from the value "20" set in the null change counter in the step S103. In step S110 the NC count of the NC counter is judged if it is 0. If the NC count is not 0, the CPU proceeds to step S112, S113, and exits to the step S105. This sequence of the steps constitutes a loop involving S105 through S113. The CPU will repeat this loop until all the 100 yen coins are discharged from the 100 yen cylinder completely. However, since the initial count of the NC counter is 20 which is greater than than actual number of coins in the cylinder, i.e. a number between 13 and 19, the loop is further repeated until the NC count is decreased to 0. At this stage the steps S105 through S107 are repeated for the empty cylinder.

When the NC counter is counted down to 0, it is determined in the step S110 that the coin recovery process is completed. The CPU then proceeds to step Sill to clear the CCR flag and returns to step S100. Since the coin selection flag has been cleared for 100 yen coins, the CPU proceeds from step S100 to step S200 shown in FIG. 5, and further to steps S201 through S213 on account of the fact that the coin selection flag is set in the step S200. Execution of the steps S201 to S213 are similar to the corresponding steps S100 through S113 for 100 yen coins except that the relevant coin storage cylinder is now the one for 50 yen coins so that 50 yen coins are now discharged.

When the coin recovery operation is finished for 50 yen coins, The CPU sequentially proceeds to steps S200 through S300 shown in FIG. 6 for discharging 10 yen coins. This sequence of the steps is basically the same as for 100 yen coins except that the steps S300 through S313 shown in FIG. 6 replace the corresponding steps S100 through S113. After the completion of this coin discharge process, the CPU returns to the standby condition.

As described above, once the entire coin recovery switch 5 is pressed, coin recovery operations for 100 yen, 50 yen, and 10 yen are performed in this order, reflecting the order of priority for higher values of coins. However, it is often the case that only a particular kind of coins be recovered, as in the case of maintenance service. In such cases, of the coin recovery switches 4 a particular one of interest is operated by the operator. For example, suppose that only 10 yen coins are to be recovered. The operator then presses a coin recovery switch 4 associated with the 10 yen coin storage cylinder, the CPU enters from the main routine to the "key input" sub-routine, and jumps from the step S10 to the step S20, from where it proceeds to the step S21 since the switch for the 10 yen coins has been operated. Since the CCR flag is not set, the CPU proceeds to the step S22 and sets CTS flag for the 10 yen coins, and returns to the main routine.

Thereafter, as the CPU enters the "coin discharge process" of FIGS. 4 to 6, the CPU goes sequentially through steps S100 and S200 to reach step S300, where the the CPU finds that the CTS flag is set for 10 yen coins, so that it proceeds to step S301 and instructs a coin recovery operation for 10 yen coins, in just the same manner as for previously described coin recovery operation for 100 yen coins.

Any current coin discharge process may be interrupted by pressing another coin recovery switch 4 during the operation. The CPU will then jump from the current operation to a newly commanded operation. For example, if the coin recovery button 4 for 10 yen coins is pressed during the coin recovery operation for 100 yen coins, the operation of the switch for 10 yen coins is recognized in the step S113 during the coin recovery operation for 100 yen coins, as seen in FIG. 4. Thus, the discharge process for the 100 yen coins will be stopped then and the CPU returns to the main routine. The CPU then enters from the main routine the "key input" sub-routine, proceeds to step S21 via steps S10, S20, and finds that the CCR flag F is set due to the fact that coin recovery operation for 100 yen had been in process. The CPU therefore clears the CCR flag in step S23. In step S24 it determines whether the coin code set in the RAM is for 10 yen. Since the operation had been for 100 yen, the coin code set in the RAM is for 100 yen. Thus, the CPU, now in step S22, sets a CTS flag for 10 yen and returns to main routine. Next, the process enters from the main routine the "coin discharge process" shown in FIG. 4. The process jumps from step S100 to step S200 of FIG. 5, and further to step S300, where CTS flag for 10 yen is found to be set, so that a coin recovery operation is executed for 10 yen coins. This operation consists of steps S301 through S313. It would be understood that this operation is similar to the foregoing coin recovery operations for 100 yen and 50 yen.

What is claimed is:

1. A coin processor comprising:

a coin classifying mechanism for reclassifying coins deposited in an automatic vending machine;

a multiplicity of coin storage cylinders for storing the coins classified by the coin classifying mechanism;

change sensors provided one for each of said coin cylinders for sensing predetermined numbers of coins in the cylinders;

a multiplicity of coin discharging mechanisms provided one for each said coin storage cylinder;

a multiplicity of coin recovery switches for enabling said discharging mechanisms to recover coins from said storage cylinders;

a controller for controlling the operations of said coin discharging mechanisms such that said coin discharging mechanisms discharge coins from the coin storage cylinders one by one in response to signals selectively received from said coin recovery switches, and the coin processor is characterized in that said coin recovery switches comprise an entire coin recovery switch for recovering the entirety of coins from the coin storage cylinders, and a multiplicity of one-type coin recovery switches for recovering from said storage cylinders specific types of coins designated by said one-type coin recovery switches operated; and said controller controlling said coin discharging mechanisms so that the entirety of coins are discharged from said coin storage cylinders in sequence in response to the signal received from the entire coin recovery switch, said controller including initial value setting means for presetting an initial number for each of the coin storage cylinders, said initial number being greater than the maximum number that said change sensors can sense; and a counter for counting down by one the count stored in the counter every time the associated coin discharging mechanism is operated after the corresponding change sensor senses the preset initial number, and for stopping the coin discharging mechanism when the number is counted down to zero.

2. A coin processor as claimed in claim 1, wherein said controller comprises: stopping means for stopping coin discharge process initiated by a first operation of the entire coin recovery switch, in response to a second operation of the entire coin recovery switch.

3. A coin processor as claimed in claim 1, wherein said controller comprises: shift means for stopping the current coin discharge process initiated by the operation of the entire coin recovery switch if one of the one-type coin recovery switches is operated during the coin discharge process, and for executing the coin recovery operation instructed by said one-type coin recovery switch.

4. A coin processor comprising:

a coin classifying mechanism for classifying coins deposited in an automatic vending machine;

a multiplicity of coin storage cylinders for storing the coins classified by the coin classifying mechanism;

change sensors provided one for each said coin cylinder for sensing predetermined numbers of coins in the cylinders;

a multiplicity of coin discharging mechanisms provided one for each said coin storage cylinder;

a multiplicity of coin recovery switches for enabling said discharging mechanisms so as to recover coins from said storage cylinders;.

a controller for controlling the operations of said coin discharging mechanisms such that said coin discharging mechanisms discharge coins from the coin storage cylinders one by one in response to signals selectively received from said coin recovery switches, said coin recovery switches comprising an entire coin recovery switch for recovering the entirety of coins from the coin storage cylinders, and a multiplicity of one-type coin recovery switches for recovering from said storage cylinders specific types of coins designated by said one-type coin recovery switches operated; and said controller controlling said coin discharging mechanisms so that the entirety of coins are discharged from said coin storage cylinders in sequence according to a priority assigned to each of said cylinders in response to the signal received from the entire coin recovery switch, wherein said controller includes selection means for switching from one coin discharge process initiated by one of the one-type coin recovery switches to another coin discharge process for another type of coins if another one of the one-type coin recovery switches is operated.

* * * * *